US005109919A

United States Patent [19]

Sakuma et al.

[11] Patent Number: 5,109,919

[45] Date of Patent: May 5, 1992

[54] HEAT EXCHANGER

[75] Inventors: Kiyoshi Sakuma; Takayuki Yoshida; Tomohumi Tezuka; Katsuyuki Aoki; Makoto, all of Yamada, Shizuoka; Masao Hujii; Ken Morinushi, both of Amagasaki, all of Japan

[73] Assignee: Mitsubishi Denki Kabushiki Kaisha, Tokyo, Japan

[21] Appl. No.: 671,645

[22] Filed: Mar. 20, 1991

Related U.S. Application Data

[63] Continuation of Ser. No. 373,284, Jun. 29, 1989, abandoned.

[30] Foreign Application Priority Data

Jun. 29, 1988 [JP] Japan ..... 63-161298

[51] Int. Cl.[5] ..... F28D 1/04; F28F 1/32

[52] U.S. Cl. ..... 165/151; 165/181; 165/182

[58] Field of Search ..... 165/151, 181, 182

[56] References Cited

U.S. PATENT DOCUMENTS

| | | | |
|---|---|---|---|
| 3,135,320 | 6/1964 | Forgo | 165/151 |
| 3,916,989 | 11/1975 | Harada et al. | 165/151 |
| 4,434,844 | 3/1984 | Sakitani et al. | 165/151 |
| 4,550,776 | 11/1985 | Lu | 165/151 |
| 4,709,753 | 12/1987 | Reifel | 165/151 |
| 4,723,599 | 2/1988 | Hanson | 165/151 |
| 4,832,117 | 5/1989 | Kato et al. | 165/151 |

FOREIGN PATENT DOCUMENTS

| | | | |
|---|---|---|---|
| 0079090 | 5/1983 | European Pat. Off. | 165/151 |
| 0184944 | 6/1986 | European Pat. Off. . | |
| 0082690 | 5/1982 | Japan | 165/151 |
| 58-28991 | 2/1983 | Japan . | |
| 0194293 | 10/1985 | Japan | 165/151 |
| 0266391 | 11/1987 | Japan | 165/151 |

OTHER PUBLICATIONS

"First report on flow pattern and heat transfer characteristics of louver fin, B303," presented at the 19th Heat transfer symposium.

*Primary Examiner*—John K. Ford

*Attorney, Agent, or Firm*—Oblon, Spivak, McClelland, Maier & Neustadt

[57] ABSTRACT

A fin-and-tube heat exchanger comprises a fin plate, a heat exchanger tube having portions extending through the fin plate, a plurality of fin collars formed in the plate, wherein louvers are provided so as to surround the tube portions except areas nearest to the collars, the louvers are in parallel with one another and project from alternately both surfaces of the plate, the louver which is located at the trailing edge side and at a position near to a central line of the tube bank is longitudinally extended so as to be along the collars and has opposite rising ends extending from the plate slanted toward the corresponding tube portions at an angle of 35 deg or below to the flow direction of the fluid, and the louver which is located at a position nearer to the trailing edge is also longitudinally extended and has opposite rising ends extending from the plate slanted toward the corresponding tube portions at an angle of 35 deg or above to the flow direction of the fluid so that the angle between the rising ends slanted at an angle of 35 deg or above and the rising ends slanted at an angle of 35 or below is 35 deg or below.

6 Claims, 11 Drawing Sheets

3
2
1
2a
2b
A
B
α2
α1
7
A
6

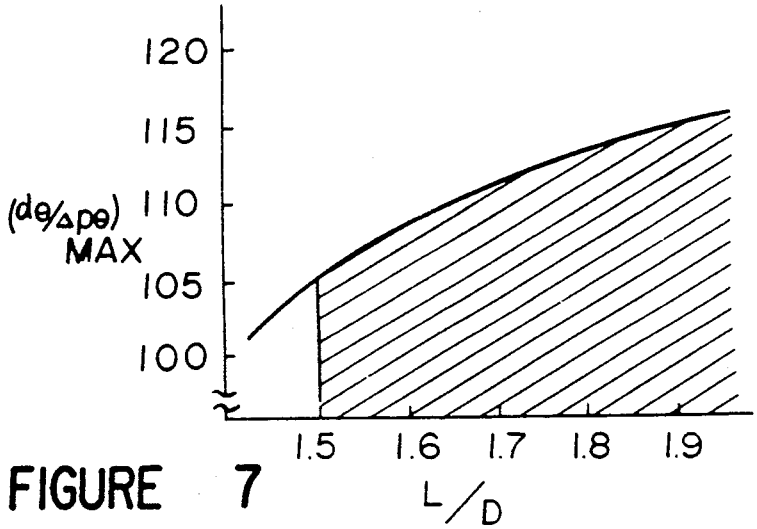
FIGURE 7
FIGURE 8(a)
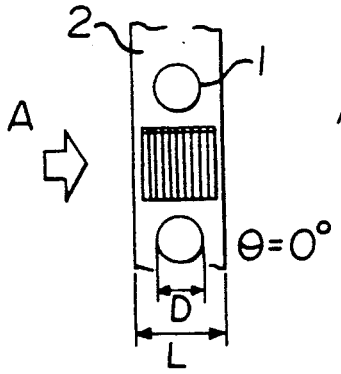
FIGURE 8(b)
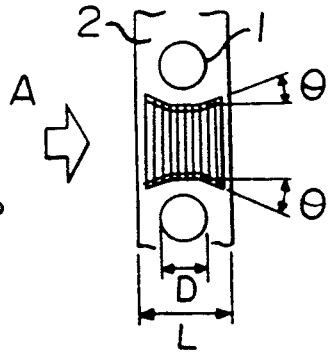

FIGURE 9
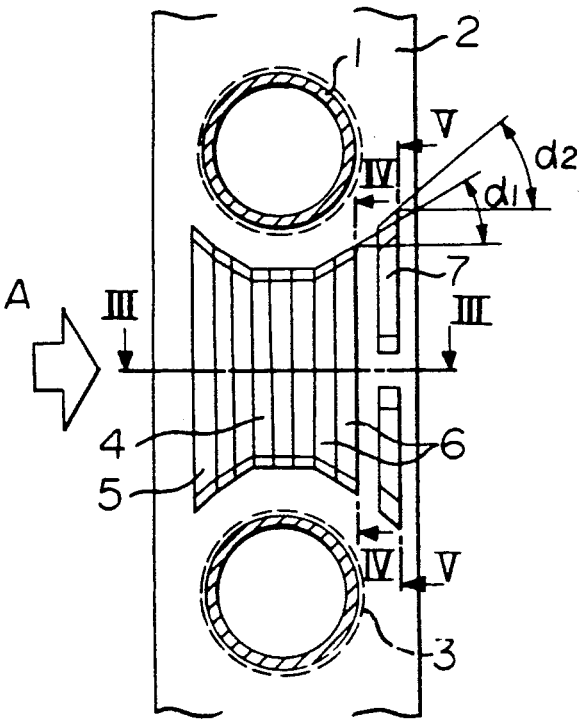
FIGURE 10
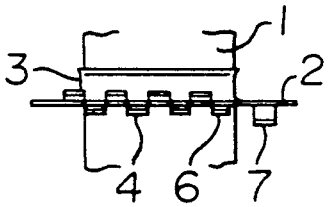
FIGURE 11
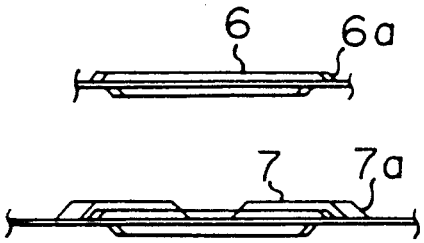
FIGURE 12

FIGURE 18
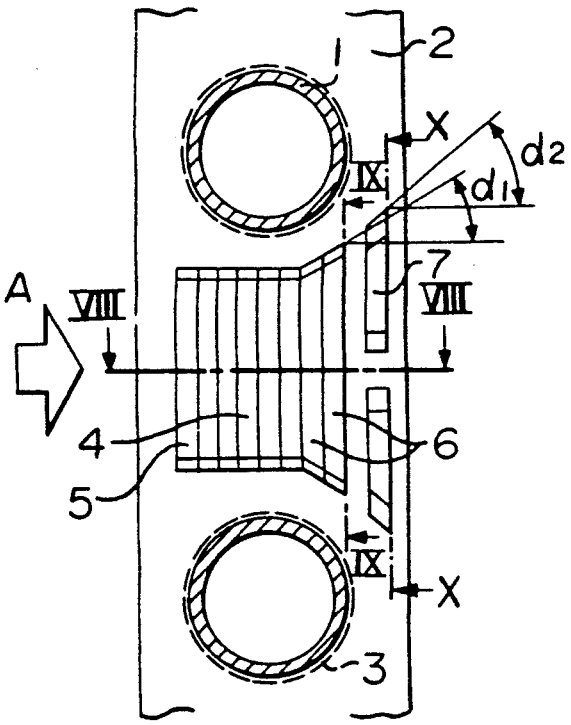
FIGURE 19
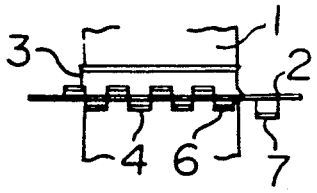
FIGURE 20
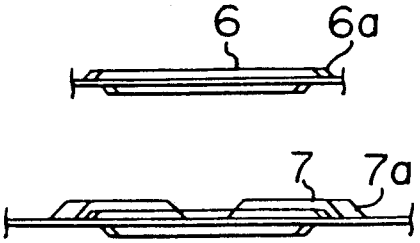
FIGURE 21

HEAT EXCHANGER

This application is a continuation of Ser. No. 07/373,284, filed on Oct. 29, 1989, now abandoned.

BACKGROUND OF THE INVENTION

The present invention relates to a fin-and-tube heat exchanger wherein a heat exchanger tube extends through a fin plate.

FIG. 23 is a vertical cross-sectional view showing the structure of a conventional fin-and-tube heat exchanger as shown in e.g. Japanese Unexamined Patent Publication No. 28991/1983. In FIG. 23, reference numeral 1 designates a heat exchanger tube. Reference numeral 2 designates a fin plate. Reference numeral 3 designates a tube-receiving collar which is formed in the fin plate 2, and which the heat exchanger tube 1 is fitted in and thermally connected to. Reference numerals 4 and 5 designate longitudinal louvers which are slitted and bent from the fin plate 2, constituting a shorter slit and a longer slit, respectively. Reference numerals 2*a* and 2*b* designate a leading edge and a trailing edge with respect to the flow direction A of a fluid.

The heat exchanger is constructed as a cross fin tube heat exchanger wherein banks of straight tubular portions (portions of the heat exchanger tube 1) are arrayed in a zigzag or grid pattern with respect to the fin plate 2, and the louvers 4 and 5 having a narrow width are provided at the fin plate 2 so as to be perpendicular to the flow direction A of the fluid. The louvers 4 and 5 are symmetrical with respect to a central line of the tube bank in the vertical direction. The width $L_1$ of non-slitted part which is located at a central position between the adjacent vertical tube banks is twice the width $L_2$ of the parts which are located between the leading edge 2*a* of the plate 2 and the louver nearest to the leading edge and between the trailing edge 2*b* and the louver nearest to the trailing edge. The same press die is used to shape one sheet, two sheets, three sheets or more of the fin plate 2 so that the assembled fin plates can be balanced against the blast output of an air conditioner and so on. A plurality columns of the fin plates can be used to construct a heat exchanger for an air conditioner with a dehumidifying function. In a similar way, the heat exchanger having the banks of the straight tubular portions arrayed in a zigzag or grid pattern can be easily obtained. In addition, heat transfer efficiency of the fin plate 2 can be increased, and flow loss of the plate can be decreased.

Because the conventional heat exchanger is constructed as stated earlier, a stagnant fluid zone B, e.g. stagnation of the fluid can be generated behind the heat exchanger tube 1 in the flow direction A of the fluid, and heat transfer performance is remarkably lowered in the stagnant fluid zone B of the fin plate 2, creating a problem wherein heat transfer performance of the whole heat exchanger is lowered. In addition, there is another problem wherein resistance to the fluid caused by the shape of the heat exchanger tube 1 is great to increase fluid loss because the stagnant fluid zone B is big.

SUMMARY OF THE INVENTION

It is an object of the present invention to eliminate these problems, and to provide a high performance heat exchanger wherein the stagnant fluid zone generated behind the heat exchanger tube can be minimized to improve heat transfer performance and to retard the increase of fluid loss.

The foregoing and the other object of the present invention have been attained by providing a fin-and-tube heat exchanger comprising: a fin plate; a heat exchanger tube having portions extending through the fin plate; a plurality of fin collars formed in the plate, having the tube portions extended therethrough for thermally connecting the tube to the plate; and a plurality of louvers provided at both surfaces of the plate between the adjacent collars in a direction transverse to the flow direction of a fluid so as to project from the surfaces; wherein the louvers are provided so as to form a continuous border surrounding the tube portions except areas nearest to the collars, the louvers are in parallel with one another and project from alternately both surfaces of the plate, the louver which is located at the trailing edge side and at a position near to a central line of the tube bank is longitudinally extended so as to be along the collars and has opposite rising ends extending from the plate slanted toward the corresponding tube portions at an angle of 35 deg or below to the flow direction of the fluid, and the louver which is located at a position nearer to the trailing edge is also longitudinally extended and has opposite rising ends extending from the plate slanted toward the corresponding tube portions at an angle of 35 deg or above to the flow direction of the fluid so that the angle between the rising ends slanted at an angle of 35 deg or above and the rising ends slanted at an angle of 35 or below is 35 deg or below.

In the heat exchanger according to the present invention, the rising ends of the louvers are slanted at an angle to the flow direction of the fluid which can smoothly direct the fluid flow behind the heat exchanger tube to prevent the fluid flow from detaching itself from the tube. As a result, the stagnant fluid zone generated behind the heat exchanger tube, and flow loss of the fluid can be minimized, improving heat transfer performance.

BRIEF DESCRIPTION OF THE DRAWINGS

In drawings:

FIG. 7 is a graphical representation showing the relation of the maximum value of the ratio of heat transfer performance and flow loss to the ratio of the outer diameter of the tube-receiving collar and the column pitch of the fin plate;

FIGS. 8(*a*) and (*b*) are plan views the shape of the fin plates, heat transfer performance and flow loss of which are measured;

FIGS. 9 through 13 are views showing a second embodiment of the present invention, FIG. 9 being a plan view showing the fin plate, FIG. 10 being a cross-sectional view taken along line III—III of FIG. 9, FIG. 11 being a cross sectional view taken along line IV—IV of FIG. 9, FIG. 12 being a cross-sectional view taken along line V—V of FIG. 9, and FIG. 13 being a drawing to help explain the movement of the fluid;

FIGS. 18 through 22 are views showing a fourth embodiment of the present invention, FIG. 18 being a plan view of the fin plate of the fourth embodiment, FIG. 19 being a cross-sectional view taken along line VIII—VIII of FIG. 18, FIG. 20 being a cross-sectional being a cross-sectional view taken along X—X of FIG. 18;

DETAILED DESCRIPTION OF THE PREFERRED EMBODIMENT

Now, the present invention will be described in detail with reference to preferred embodiment illustrated in the accompanying drawings.

Figure 1:
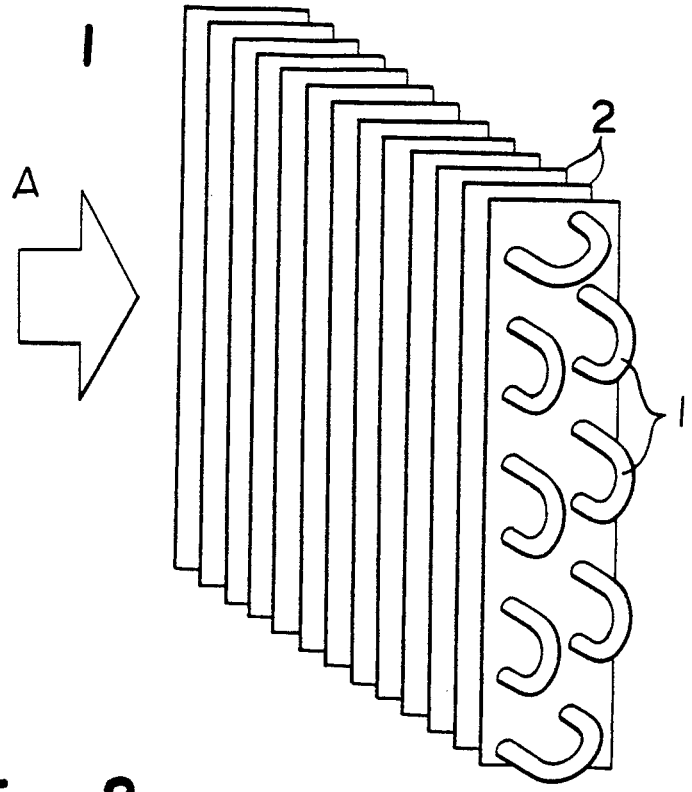
FIG. 1 is a perspective view showing the schematic shape of the heat exchanger according to the present invention.

FIG. 1 is a perspective view showing the schematic shape of the fin and tube heat exchanger according to the present invention. As shown, a plurality of straight tubular portions constituting a exchanger tube 1 are fitted in and extend through a plurality of fin plates 2 in the shape of banks. The fin plate 2 are arranged in parallel to the flow direction A of a fluid.

Figure 2:
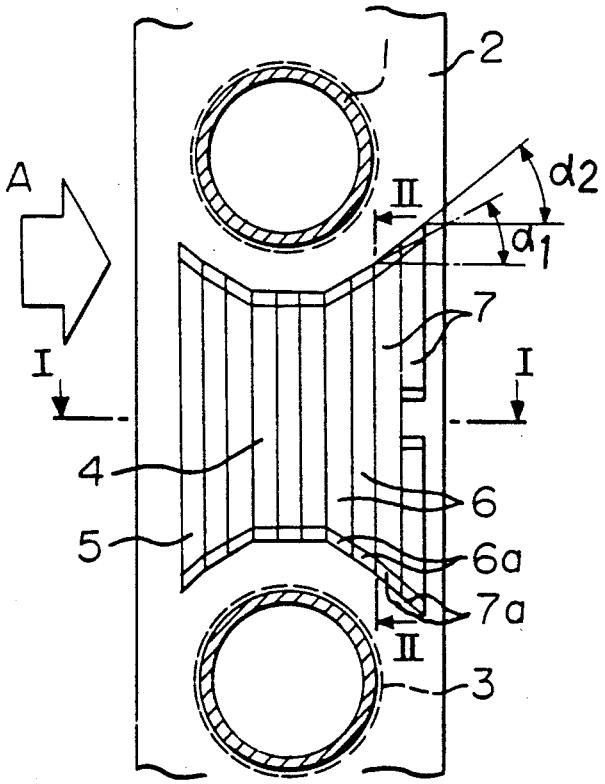
FIGS. 2 through 5 are views showing a first embodiment of the present invention, FIG. 2 being a plan view of the fin plate, FIG. 3 being a cross-sectional view taken along line I—I of FIG. 2, FIG. 4 being a cross-sectional view taken along line II—II of FIG. 2, and FIG. 5 being a drawing to help explain the movement of a fluid.
Figure 3:
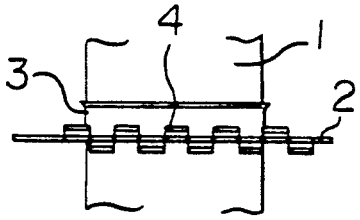
Figure 4:
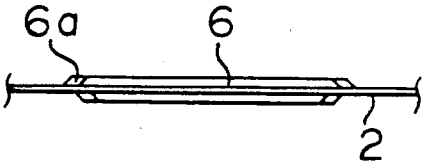
Figure 23:
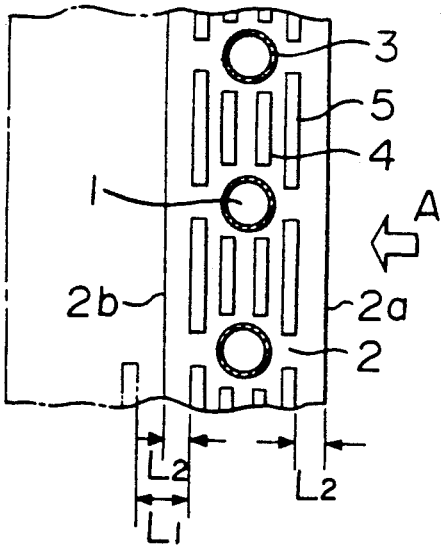
FIGURE 23 PRIOR ART
FIG. 23 is a plan view showing the fin plate of a conventional heat exchanger.
Figure 24:
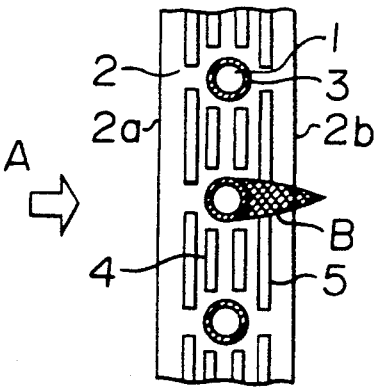
FIGURE 24 PRIOR ART
FIG. 24 is a drawing to help explain the movement of a fluid with respect to the conventional fin plate.

Next, a first embodiment of the present invention will be described in reference FIGS. 2 through 4. FIG. 2 is a plan view of the fin plate 2 of the first embodiment, and FIGS. 3 and 4 are a cross-sectional view taken along line I—I and a cross sectional view taken along line II—II of FIG. 2. The same reference numerals as those of FIGS. 23 and 24 showing the conventional heat exchanger designate identical or corresponding parts. In FIGS. 2 through 4, reference numeral 1 designates a straight tubular portion of a heat exchanger tube. Reference numeral 2 designates a fin plate. Reference numeral 3 designates a plurality of fin collars which are formed in the fin plate 2, in which the tube portion 1 is fitted, and through which the heat exchanger tube 1 is thermally connected to the fin plate. Reference numerals 4, 5, 6 and 7 designate louvers which are slitted and bent from the fin plate 2. The louvers are each formed as a single projection extending between the adjacent fin collars in a direction transverse to the flow direction A of the fluid. The louvers are arranged to form a continuous border surrounding the tube portions 1 except the area around the fin collars 3. The louvers are in substantial parallel to one another, and project from alternately the opposite surfaces of the fin plate 2. The louvers are longitudinally extended to be along the fin collars.

The louvers 6 which are located at the trailing edge side in terms of the flow direction A of the fluid and at a position near to a central line of the bank of the tube portions 1 in the vertical direction have their extended ends forming rising ends 6*a* extending from the fin plate 2. The rising ends 6*a* are formed to slant towards the corresponding tube portions at an angle $\alpha_1$ to the flow direction of the fluid, the angle $\alpha_1$ satisfying the equality, $\alpha_1 < 35$ deg. The louvers 7 which are located at a position nearer to the trailing edge than the louvers 6 have their extended ends forming rising ends 7*a* extending from the fin plate 2. The rising ends 7*a* are formed to slant toward the corresponding tube portions at an angle $\alpha_2$ to the flow direction A of the fluid, the angle $\alpha_2$ satisfying the inequalities, $\alpha_2 > 35$ deg and $(\alpha_2 - \alpha_1) < 35$ deg.

Figure 5:
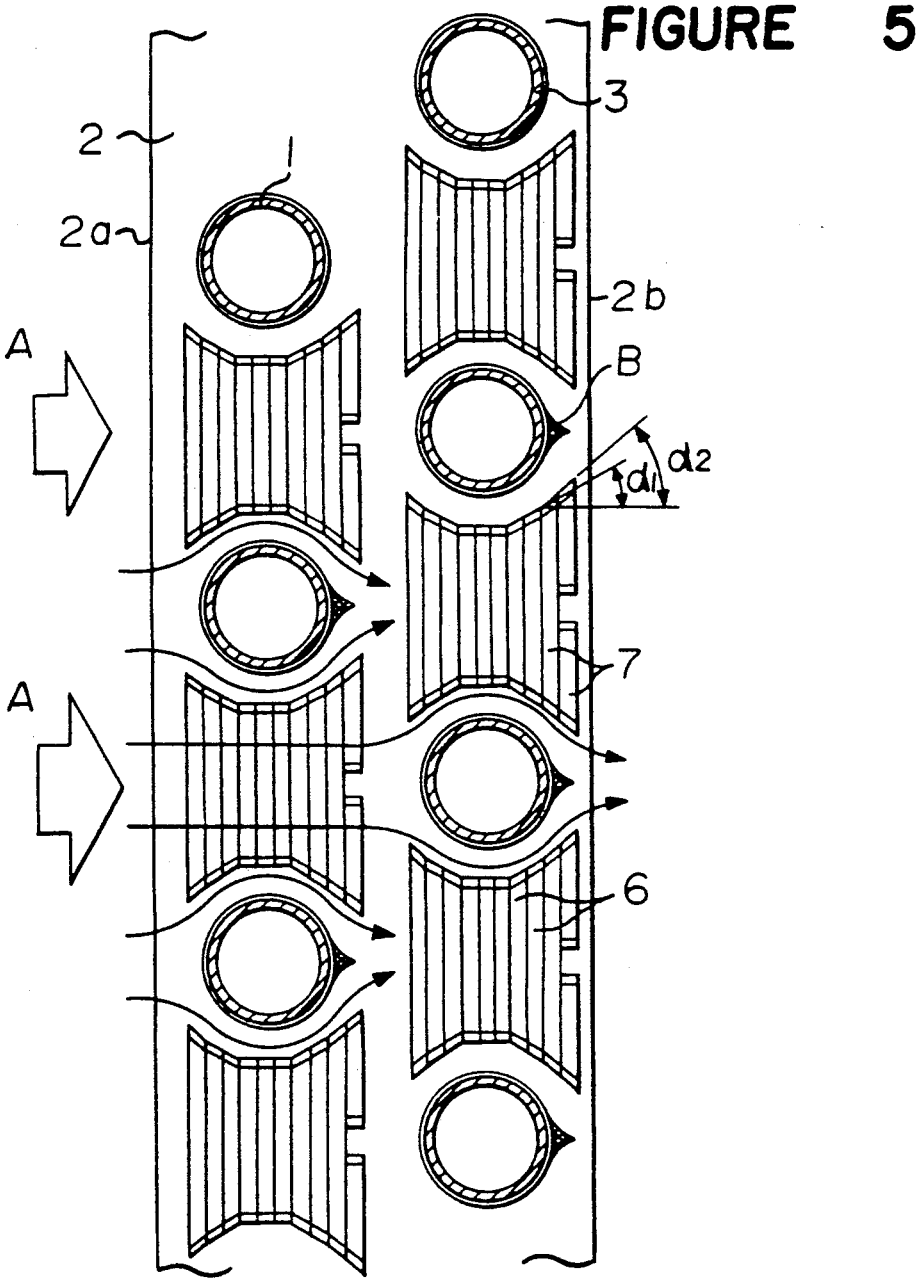

In the heat exchanger having such structure, the fluid enters at the leading edge 2*a* of the fin plate 2, and flows along the tube portions 1 in their vicinities as shown in FIG. 5. The fluid which has passed the vicinities of the tube portions flows along the rising ends 6*a* of the louvers 6 which are slanted toward the corresponding tube portions 1 at the angle $\alpha_1$ to the flow direction A. After that, the fluid flows along the rising ends 7*a* of the louvers 7 which are slanted toward the corresponding tube portions 1 at the angle $\alpha_2$, and the fluid enters behind the tube portions 1. As a result, the stagnant fluid zones B behind the tube portions 1 can be significantly minimized, improving heat transfer performance of the fin plate 2 and decreasing the shape resistance of the heat exchanger tube 1.

With regard to a fluid in a low level of Reynold's number region such as the air passing through a fin and tube heat exchanger used for an air conditioner, i.e. inflow air whose flow takes the shape of laminar flow boundary layer, separation caused by changing the angle of the fluid flow is known to take place when the angle is about 35 deg or above [See the article entitled "B303 heat transfer analysis on heat exchanger fin (first report on flow pattern and heat transfer characteristics of louver fin)" presented to 19th Heat Transfer Symposium (1982-5)].

In order to minimize the stagnant fluid zones B to improve heat transfer performance and at the same time to reduce air flow resistance (form drag) of the heat exchanger tube 1, it would be thought that the angle $\alpha_1$ is increased to help the air to flow into the stagnant fluid zones B behind the tube portions 1. However, when the inequality, $\alpha_1 \geqq 35$ deg is satisfied, separation of the flow takes place at the rising ends 6*a* of the louvers 6 as described in the article stated above, thereby increasing the air flow resistance. In accordance with the first embodiment, the inequalities, $\alpha_1 < 35$ deg, $\alpha_2 > 35$ deg and $(\alpha_2 - \alpha_1) < 35$ deg are satisfied, and the rising ends 6*a* and 7*a* of the louvers 6 and 7 are gradually slanted toward the corresponding tubular portions. This can prevent the whole flow of the fluid from detaching itself at the louvers 6 and 7 with respect to the flow direction A, allowing the fluid flow to be bent at an angle of 35 deg or above.

Figure 6A:
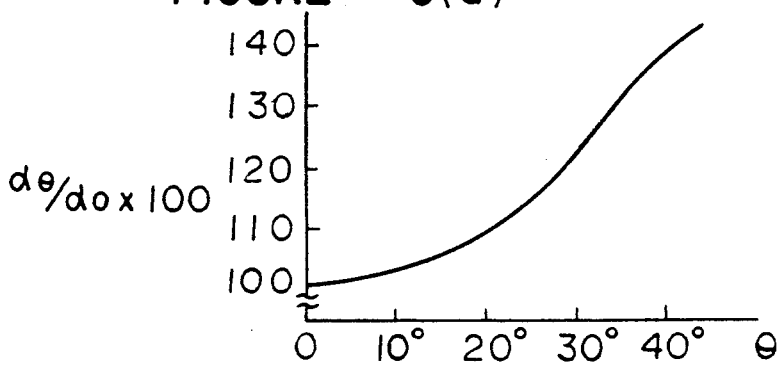
FIGS. 6(*a*), (*b*) and (*c*) are graphical representations showing the relation between the angle of the louver to the flow direction of the fluid, heat transfer performance, and flow loss.
Figure 6B:
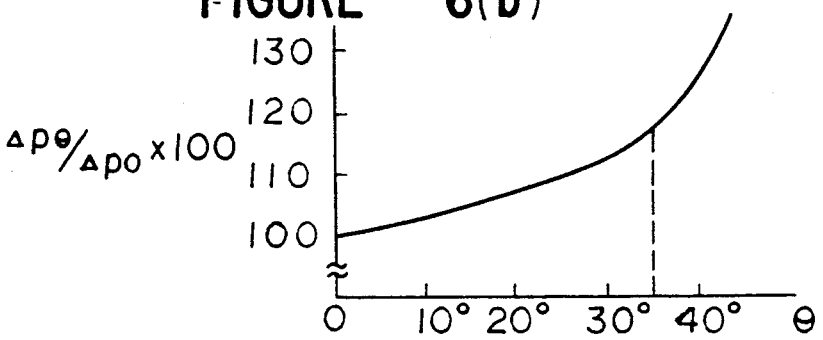
Figure 6C:
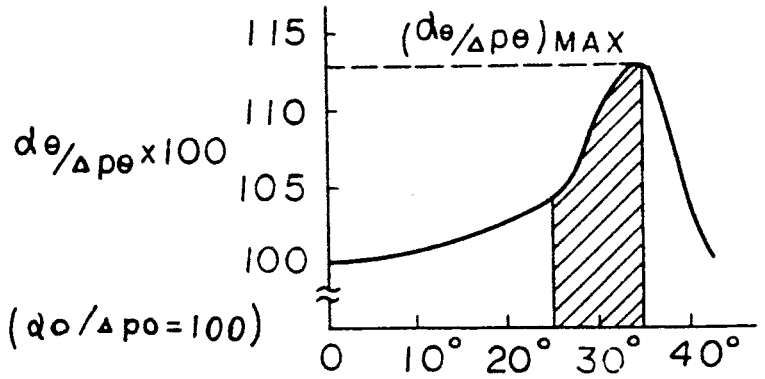

FIGS. 6(*a*), (*b*) and (*c*) and FIG. 7 are drawings showing characteristics obtained as the results of the study on heat transfer performance and flow loss of the fin plate 2 shown in FIGS. 8(*a*) and (*b*).

An angle $\theta$ shown in FIG. 8 is the angle at which the rising ends 6*a* of the louvers 6 which are formed at a position nearer to the trailing edge than the center line of the tube portions 1 (bank center) as seen from the flow direction A of the fluid crosses the flow direction A. Reference D designates the outer diameter of the hole (fin collar 3) in which the heat exchanger tube is fitted. Reference L designates a column pitch of the fin plate 2 (which is fin width in case of the shown embodiment). FIG. 6(*a*) is the graphical representation showing heat transfer performance $\alpha$. In FIG. 6(*a*), the horizontal axis is the angle $\theta$, and the vertical axis is heat transfer performance ratio $\alpha_{74}/\alpha_0 \times 100$, wherein the heat transfer performance of the fin plate 2 with the angle $\theta=0°$ is indicated as the reference value (100). FIG. 6(*a*) shows that as the angle $\theta$ increases, the heat transfer performance improves.

FIG. 6(*b*) is the graphical representation showing flow loss $\Delta P_{74}$. In FIG. 6(*b*), the horizontal axis is the angle $\theta$, and the vertical axis is flow loss ratio ($\Delta P_\theta/\Delta P_0 \times 100$) wherein the flow loss of the fin plate 2 having the angle $\theta=0°$ shown in FIG. 8(*a*) is indicated as reference value 100. FIG. 6(*b*) shows that as the angles $\theta$ increases, the flow loss also increases, and the rate-of-climb of the curve $\theta$ becomes significantly great around 35 deg. This shows that the separation of the flow occurs at an angle of 35 deg or above, which conforms to the results as described in the article as mentioned earlier. This proves that when the rising ends formed at the fin plate 2 are set so that the angle at which the fluid flow turns at a time is 35 deg or below, it is possible to restrain an increase in the flow loss and to improve the heat transfer performance.

FIG. 6(*c*) shows ratio $\alpha_\theta$ [heat transfer performance $\alpha_\theta$ of FIG. 6(*a*)]/$\Delta P_0$ [flow loss $\Delta P_\theta$ of FIG. 6(*b*)], wherein ratio $\alpha_0/\Delta P_0$ is indicated as reference value 100. FIG. 6(*c*) shows that as the angle $\theta$ increases, the ratio $\alpha_{74}/\Delta P_0$ is gradually increasing, and that it abruptly increases at an angle of 25 deg or above and reaches the maximum value at around 35 deg. FIG. 6(*c*) also shows that the ratio $\alpha_\theta/\Delta P_\theta$ abruptly decreases at an angle 35 deg or above. That is to say, when the angle $\theta$ becomes 35 deg or above, the flow loss abruptly increases, creating problems resulting from the limited performance of the air blower and noise of the air blower. This proves that the angle $\alpha_1$ of FIG. 2 is preferable to be in the range of $25° \leqq \alpha_1 \leqq 35°$ (hatched range), obtaining better results. As can be seen from FIG. 6(*c*), even when the angle is 25 deg or below, good results can be obtained, and even when the angle is 35 deg or above, good results could be obtained by improving the performance of air blower or improving the air passage in the heat exchanger.

In FIG. 7, the horizontal axis is a ratio L/D of the column pitch (fin width in case of one column) L to the outer diameter D of the tube receiving hole in FIG. 8, and the vertical axis is the maximum value $(\alpha_\theta/\Delta P_\theta)_{MAX}$ as shown in FIG. 6(*c*) at the respective ratio L/D. FIG. 7 shows that when the ratio L/D is 1.5 or above (in the hatched range), the rising ends of the louvers 6 and 7 provided at the fin plate 2 can be slanted at the angles $\alpha_1$ and $\alpha_2$ to the flow direction A of the fluid to obtain better results. This is because when the ratio L/D is 1.5 or below, the distance from the rear portion of the tube portions 1 to the trailing edge 2*b* of the fin plate 2 is short, the proportion of the area of stagnant fluid zones B behind the tube portions 1 to the whole surface area of the fin plate is primarily small, and a great deal of decreasing effect for the stagnant fluid zones B can not be obtained.

FIG. 9 through 13 show a second embodiment of the present invention, FIG. 9 being a plan view showing the fin plate 2 of the second embodiment, FIG. 10 being a cross-sectional view taken along line III—III of FIG. 9, FIG. 11 being a cross-sectional view taken along line IV—IV of FIG. 9, and FIG. 12 being a cross-sectional view taken along line V—V of FIG. 9.

In the second embodiment, the angle of the rising ends of the louvers to the flow direction A of the fluid is the same as that of the first embodiment. The second embodiment is different from the first embodiment in that the height from the fin plate 1 of the louver 7 having the rising ends slanted at an angle $\alpha_2$ (>35 deg) is greater than that of the louvers 6 (provided that the louver 7 is not in touch with an adjacent fin plate).

Figure 13:
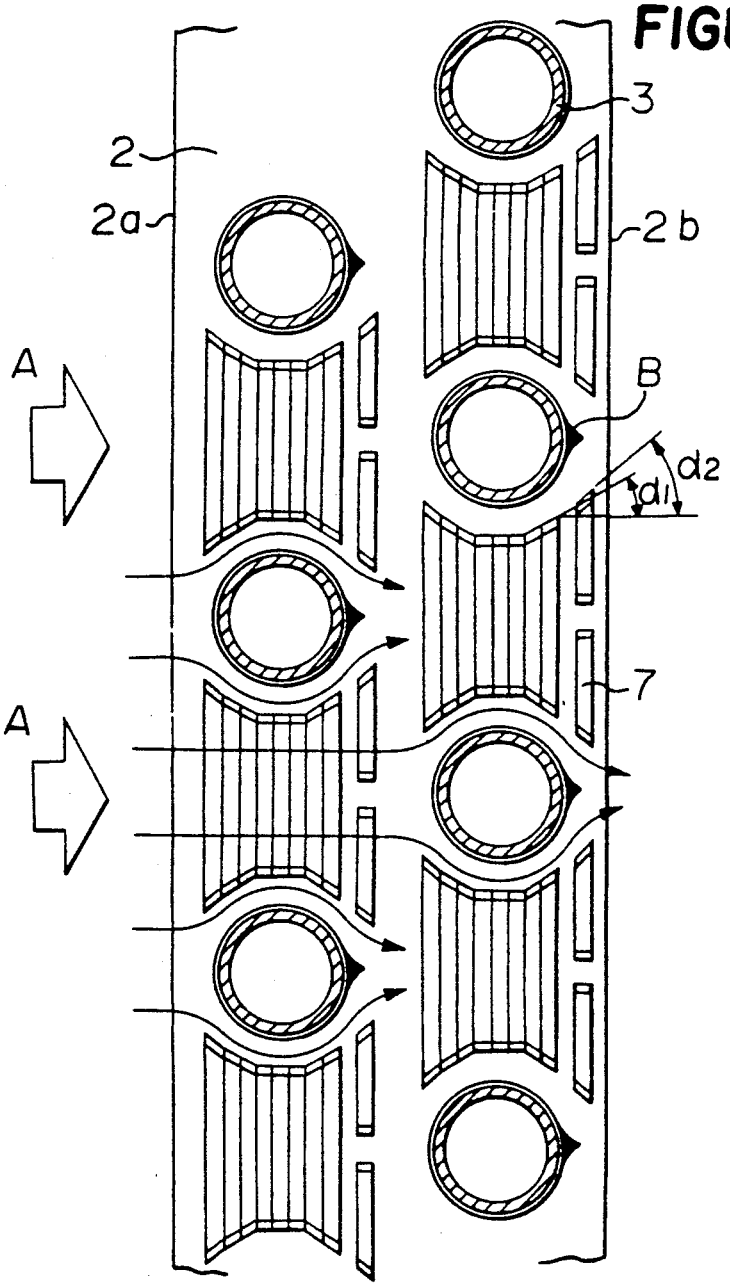

Such structure can further help the fluid (the air flowing between the fin plates) to flow into the stagnant fluid zones B behind the tube portions 1, thereby further decreasing the area of the stagnant fluid zones B, and to far advance the heat transfer performance of the fin plate as shown in FIG. 13.

Figure 14:
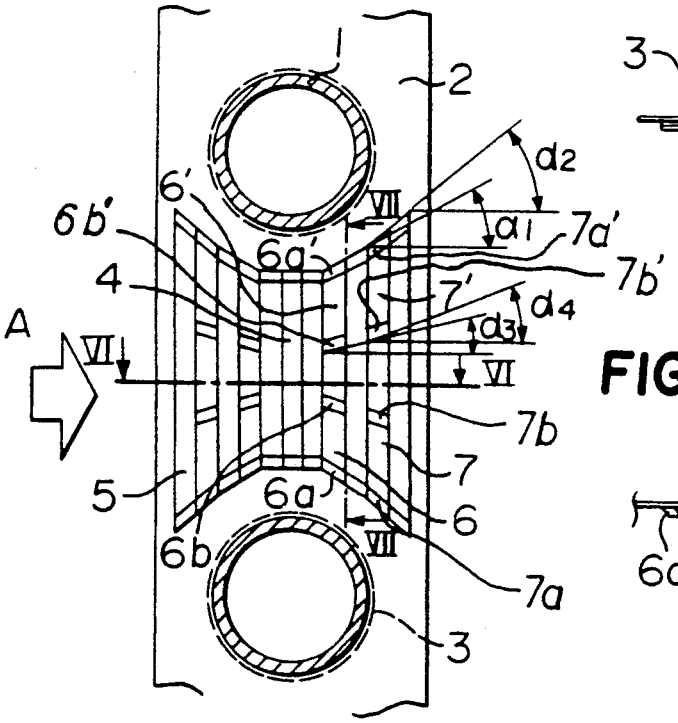
FIGS. 14 through 17 are views showing a third embodiment of the present invention, FIG. 14 being a plan view of the fin plate of the third embodiment, FIG. 15 being a cross-sectional view taken along line VI—VI of FIG. 14, FIG. 16 being a cross-sectional view taken along line VII—VII of FIG. 14, and FIG. 17 being a drawing to help explain the movement of the fluid.
Figure 15:
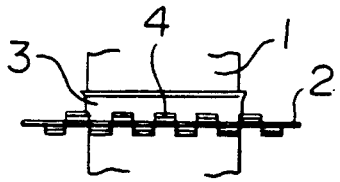
Figure 16:
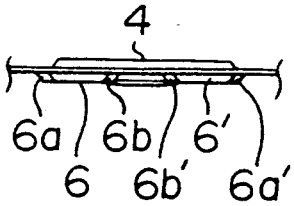

Next, a third embodiment of the present invention will be explained in reference to FIGS. 14 through 17. FIG. 14 is a plan view showing the fin plate 2 of the third embodiment, FIG. 15 is a cross-sectional view taken along line VI—VI of FIG. 14, and FIG. 16 is a cross-sectional view taken along line VII—VII of FIG. 14.

In the third embodiment, every other louver among the louvers which are arranged in sequence along the flow direction A is slitted and bent from the fin plate so as to be divided into two parts as shown in FIG. 14. Facing rising ends 6*b* and 6*b*′ of the divided louver which are located at the trailing edge of the plate and at a central portion between the receiving holes are slanted toward the corresponding tube portions 1 at an angle $\alpha_3$ to the flow direction A, the angle $\alpha_3$ satisfying the inequality, $\alpha_3$(<17.5 deg). Facing rising ends 7*b* and 7*b*′ of the divided louver parts 7 and 7′ which are located at a position nearer to the trailing edge of the fin plate than the divided louver parts 6 and 6′ and at a central portion between the tube receiving holes are slanted towards the corresponding tube portions at an angle $\alpha_4$ to the flow direction A, and the angle $\alpha_4$ satisfying the inequality $\alpha_4$ (>17.5 deg).

The rising ends 6*a*, 7*a* and so on which constitute parts of the plural louvers and are located along the tube portions 1 have structures similar to those of the first embodiment as shown in FIG. 2 through 4.

In the heat exchanger of the third embodiment, the fluid enters at the leading edge 2*a* of the fin plate 2, and flows along the tube portions 1 in their vicinities. The fluid which has passed the tube portions 1 flows along the rising end 6*a* of the louver 6 which is slanted toward the corresponding tube portion 1 at the angle $\alpha_1$ to the flow direction A. After that, the fluid flows along the rising end 7*a* of the louver 7 which is slanted toward the corresponding tube portion 1 at the angle $\alpha_2$, and enters behinds the tube portion 1.

On the other hand, after the fluid which has flowed into the group of the plural louvers between the tube receiving holes has passed the tube portions 1, the fluid flows along the rising ends 6*b* and 7*b* of the fin plate 2 which are located at the central portion between the tube receiving holes and slanted at the angles $\alpha_3$ and $\alpha_4$ to the flow direction A, respectively. This can be further promote the flow of the fluid entering behind the tubes 1.

Figure 17:
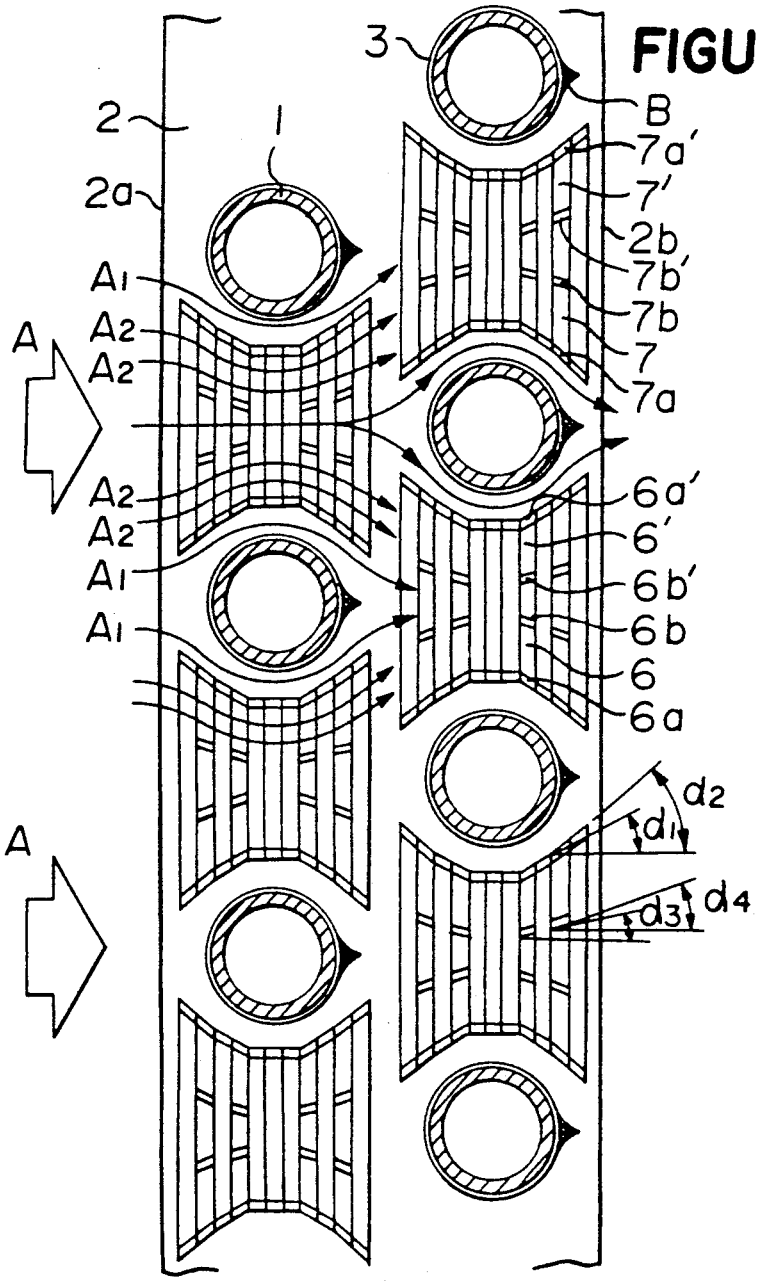
Figure 22:
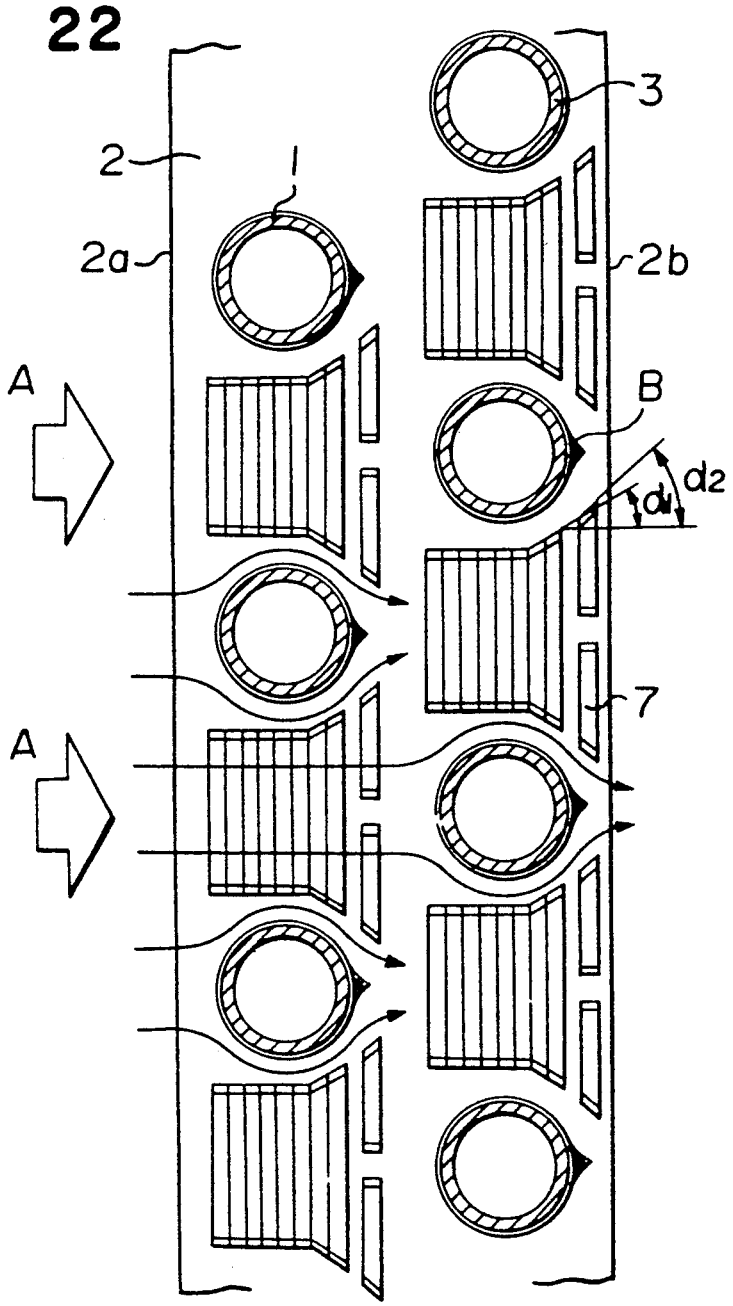

Since the angle $\alpha_3$ and $\alpha_3$ satisfy the inequalities $\alpha_3$<17.5 deg and $\alpha_4$>17.5 deg, and the angles gradually become greater, the separation of the fluid can be restrained as shown in FIG. 17 to reduce the area of stagnant fluid zones B behind the tube portions, remarkably improving the heat transfer performance of the fin plate.

Because the rising ends 6b, 6b', 7b and 7b' of the fin plate 2 which are located at the central portion between the tube receiving holes are slanted at the angles $\alpha_3$ and $\alpha_4$ to the flow direction A, the whole flow of the fluid can be rectified, minimizing the flow loss.

A fourth embodiment of the present invention will be described in reference to FIGS. 18 through 22, FIG. 18 being a plan view showing the fin plate 2 of the fourth embodiment, FIG. 19 being a cross-sectional view taken along line VIII—VIII of FIG. 18, FIG. 20 being a cross-sectional view taken along line IX—IX of FIG. 18, and FIG. 21 being a cross-sectional view taken along line X—X of FIG. 18.

The fourth embodiment is different from the second embodiment in that the length of the louvers 5 which are located at a position nearer to the leading edge of the plate than the central line of the tube portions 1 (bank center) is the same as that of the louver which is located at the center in the tube bank direction. In the fourth embodiment, the shape of the louvers which are located at a position nearer to the trailing edge of the fin plate than the central line of the tube portions 1 (bank center) is the same as that of the second embodiment, offering advantage similar to the second embodiment.

In the first and third embodiment, the length of the louver which is located at a position nearer to the leading edge of the fin plate than the central line of the tube portions 1 (bank center) can be the same as that of the louver which is located at the center in the tube bank direction as the fourth embodiment, offering similar advantage.

We claim:

1. A fin-and-tube heat exchanger comprising:

at least one fin plate;

heat exchanger tubes having portion extending through the fin plate;

a plurality of fin collars formed in the plate, having the tube portions extended therethrough for thermally connecting the tube to the plate; and a plurality of louvers provided at both surfaces of the plate between adjacent collars and extending from the plate in a direction transverse to an initial flow direction of a fluid so as to project from the surfaces, said initial flow direction being substantially parallel to the plate and transverse to the length of said louvers;

wherein the louvers are provided so as to surround the tube portions such that at least three adjacent louvers immediately border one another without any intervening unlouvered portions, except in areas nearest to the collars, the louvers are in parallel with one another and project alternately from both surfaces of the plate such that each of said louvers projects from a surface of said plate opposite to a surface from which project the louvers adjacent thereto, at least one first louver which is located at a trailing edge side in the fluid flow direction and at a position near to a line of the tube bank connecting centers of said fin collars is longitudinally extended so as to be positioned along the collars and has opposite rising ends extending from the plate slanted toward the corresponding tube portions at a first angle of substantially 35 deg to the initial flow direction of the fluid, and at least two further louvers projecting from opposite surfaces of said plate, which louvers are parallel to said at least one first louver and are located at a position nearest to the trailing edge are also longitudinally extended and have opposite rising ends extending from the plate slanted toward the corresponding tube portions at a second angle of greater than 35 deg to the initial flow direction of the fluid, wherein a difference between the first angle and the second angle is 35 deg or below.

2. A heat exchanger according to claim 1 wherein at least some of the louvers comprise two divided parts.

3. A heat exchanger according to claim 2, wherein the two divided parts have opposite rising ends, respectively, and the facing rising ends of the two divided parts which are located at a central portion between the tube portions are slanted toward the corresponding tube portions at an angle of 17.5 deg or below to the initial flow direction of the fluid, respectively.

4. A heat exchanger according to claim 3, wherein the facing rising ends of the two divided parts which are located at a central position nearer to the trailing edge of the plate are slanted toward the corresponding tube portions at an angle of 17.5 or above to the initial flow direction of the fluid, respectively.

5. The heat exchanger according to claim 1 wherein said at least one first louver comprises two adjacent louvers projecting from opposite surfaces of said at least one plate.

6. A fin and tube heat exchanger comprising:

at least one fin plate;

heat exchanger tubes having portions extending through the fin plate;

a plurality of fin collars formed in the plate, having the tube portions extending therethrough for thermally connecting the tube to the plate; and a plurality of louvers provided at both surfaces of the plate between adjacent collars and extending from the plate in a direction transverse to an initial flow direction of a fluid so as to project from the surfaces, said initial flow direction being substantially parallel to the plate and transverse to the length of said louvers, wherein the louvers are provided so as to surround the tube portions, except in areas nearest to the collars, the louvers are in parallel with one another, at least two first louvers projecting alternately from both surfaces of the plate such that each of said louvers projects from a surface of said plate opposite to a surface from which project the louvers adjacent thereto, said first louvers being located at a trailing edge side in the fluid flow direction and at a position near to a line of the tube bank connecting centers of said fin collars, said first louvers being longitudinally extended so as to be positioned along the collars and having opposite rising ends extending from the plate slanted toward the corresponding tube portions at a first angle of substantially 35° to the initial flow direction of the fluid, adjacent ones of the first louvers immediately bordering one another without any intervening unlouvered portions, and at least one further louver projecting from said plate, which further louver is parallel to said first louvers and is located at a position nearest to the trailing edge, said at least one further louver being longitudinally extended and having opposite rising ends extending from the plate slanted toward the corresponding tube portions at a second angle of greater than 35° to the initial flow direction of the fluid, wherein a difference between the first angle and the second angle is 35° or below, and wherein the height from the plate of said at least one further louver is greater than that of the one of said first louvers projecting from the same side of said plate as said further louver.

* * * * *

UNITED STATES PATENT AND TRADEMARK OFFICE

CERTIFICATE OF CORRECTION

PATENT NO. : 5,109,919

DATED : May 5, 1992

INVENTOR(S) : Kiyoshi Sakuma et al.

It is certified that error appears in the above-identified patent and that said Letters Patent is hereby corrected as shown below:

On the title page, item (75) inventors, should read, --Kiyoshi Sakuma; Takayuki Yoshida; Tomohumi Tezuka; Katsuyuki Aoki; Makoto Yamada, all of Shizuoka; Masao Hujii; Ken Morinushi, both of Amagasaki, all of Japan--.

Signed and Sealed this

Sixth Day of July, 1993

*Attest:*

Michael K. Kirk

MICHAEL K. KIRK

*Attesting Officer*

*Acting Commissioner of Patents and Trademarks*